United States Patent [19]

Furgalus et al.

[11] 3,966,120

[45] June 29, 1976

[54] ULTRASONIC SPRAYING DEVICE

[75] Inventors: Keith A. Furgalus, Lakewood; Harold C. Simmons, Richmond Heights, both of Ohio

[73] Assignee: Parker-Hannifin Corporation, Cleveland, Ohio

[22] Filed: Mar. 12, 1975

[21] Appl. No.: 557,622

[52] U.S. Cl. ..... 239/102

[51] Int. Cl.[2] ..... B05B 3/14

[58] Field of Search ..... 239/102

[56] References Cited

UNITED STATES PATENTS

| | | | |
|---|---|---|---|
| 3,110,825 | 11/1963 | Miller | 239/102 |
| 3,214,101 | 10/1965 | Perron | 239/102 |
| 3,790,079 | 2/1974 | Berglund et al. | 239/102 |
| 3,804,329 | 4/1974 | Mortner | 239/102 |
| 3,860,173 | 1/1975 | Sata | 239/102 |
| 3,861,852 | 1/1975 | Berger | 239/102 |

FOREIGN PATENTS OR APPLICATIONS

| | | | |
|---|---|---|---|
| 710,653 | 9/1941 | Germany | 239/102 |
| 1,100,535 | 1/1968 | United Kingdom | 239/102 |

*Primary Examiner*—M. H. Wood, Jr.
*Assistant Examiner*—Gene A. Church
*Attorney, Agent, or Firm*—John N. Wolfram

[57] ABSTRACT

An ultrasonic spraying device for atomizing a liquid and for breaking up into fine particles any solids contained in the liquid. The device comprises an acoustical horn in which ultrasonic vibration is induced by a generator and having a surface against which liquid may be impinged. The liquid is directed against the surface by one or more conduits that are external of the horn. Means is provided for adjusting the spacing and orientation of the conduits with respect to the impingement surface, for isolating the horn vibrationally from a support upon which the horn is mounted, and the impingement surface may be of several different shapes for controlling the direction in which the impinging liquid is deflected. The invention also relates to the method of utilizing an ultrasonic horn for atomizing liquids and for breaking up solids into small particles.

18 Claims, 8 Drawing Figures

ULTRASONIC SPRAYING DEVICE

BACKGROUND OF THE INVENTION

Ultrasonic devices have heretofore been utilized in connection with the atomization of liquids, such as for atomization of liquid fuels, spraying of liquid chemicals, oxygenation of liquid sewage, and others. Ultrasonic devices for this purpose are shown, for example, in U.S. Pat. Nos. 3,214,101; 2,949,900; and 3,672,823.

In some of these prior devices, the liquid to be sprayed flows through passages within the transducer and/or the acoustical horn for subjecting the liquid to ultrasonic vibration while others have utilized conduits that are external of the transducer and horn for directing the liquid against a vibrating impingement surface of the horn. In the former case, the passages must be relatively small and are thus subject to becoming clogged from solid material that may be present in the liquid. In the case of external conduits, the conduits have not been adjustable for varying the spacing and/or angular orientation with respect to the impingement surface, the horn has not been vibrationally isolated from a support for the same, and the impingement surfaces have not been specially designed for directing the liquid deflected therefrom into desired patterns.

SUMMARY OF THE INVENTION

The present invention provides an ultrasonic horn having an impingement surface against which liquid is directed thereagainst from a conduit that is external of the transducer and/or horn. The horn is mounted on a support so as to be vibrationally isolated therefrom and in a manner so that its rotational position with respect to the support can be varied. The support has an arm attached thereto that supports the conduit and there is a means associated with the arm for changing the spacing of the conduit from the impingement surface and for varying the angular orientation with respect thereto.

The impingement surface of the horn may be formed in various configurations for producing a desired spray pattern in the liquid being deflected therefrom.

The invention also provides for a plurality of conduits for directing liquid against a common impingement surface of the acoustical horn. The conduits may all carry like liquids or they may carry two or more different liquids. In this manner, two or more different liquids may be mixed at the point of impingement on the acoustical horn so as to gain the benefit of synergistic effects of ultrasonic vibration in a chemical reaction or for obtaining an emulsification or other mixing of the different liquids.

DETAIL DESCRIPTION

Figure 1:
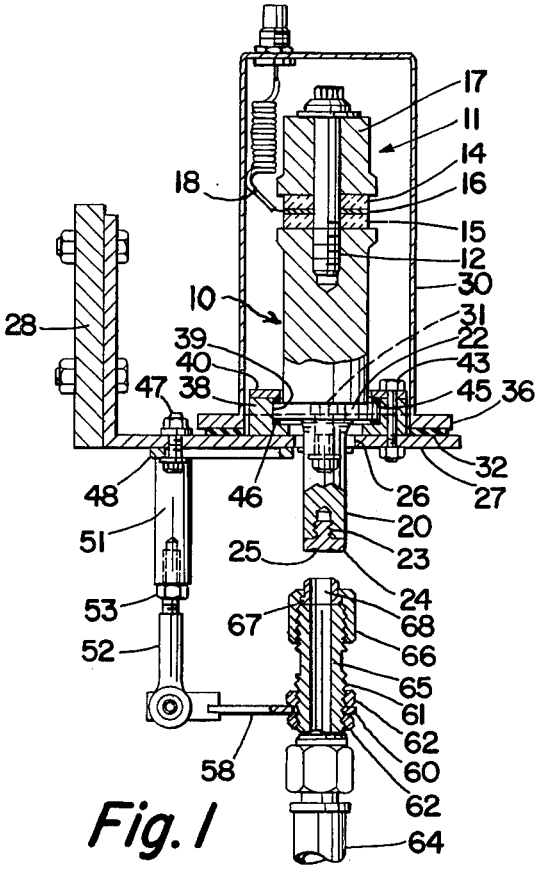
FIG. 1 is a cross section view of the device with one external conduit for the liquid.
Figure 2:
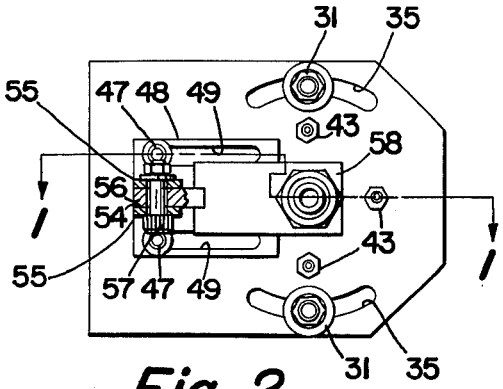
FIG. 2 is an end view of the device of FIG. 1.

In the form of the invention shown in FIGS. 1 and 2, an acoustical horn 10 has a transducer or untrasonic sound wave generator 11 attached thereto by a bolt 12. The generator is of the well known type having a pair of piezoelectric crystals 14, 15 clamped to either side of an electrical contactor 16 and against one end of horn 10 and an opposing element by bolt 12. An electrical lead 18 connects electrical contact 16 with a source of electrical energy, not shown.

The lower end 20 of horn 10 is of reduced diameter and there is a radially outwardly extending flange 22 intermediate the ends of horn 10. Reduced diameter portion 20 has a threaded bore 23 at its lower end into which is threaded an adaptor 24 that provides an impingement surface 25. Reduced portion 20 extends through an opening 26 in a support bracket 27 that may be bolted to a wall of a tank or some other supporting structure 28.

A cup shaped housing 30 encloses generator 11 and a major portion of the acoustical horn 10 and is attached to support member 27 by a pair of bolts 31 and is sealed relative to the support structure by a gasket 32. Bolts 31 pass through arcuate slots 35 in support 27 and through a pair of bolt holes in a flange 36 on housing 30. The arcuate slots 35 permit housing 30 to be adjusted in a rotative position relative to support 27 while bolts 31 are loose but which is fixed in the desired rotative position when these bolts are tightened. Located within housing 30 is a mounting ring 38 having a recess 39 for receiving horn flange 22 which is retained in the recess by a washer 40 via several bolts 43 that pass through washer 40, ring 38 and support 27 to rigidly clamp these parts together whereby they form the support structure for the horn. The horn, however, is vibrationally isolated from washer 40 and the bottom wall of recess 39 in ring 38 by a pair of elastomeric washers 45, 46 that are tightly compressed against flange 22 by the tightening of bolts 43.

Clamped to support 27 by bolts 47 is a flat plate 48 having a pair of elongated slots 49 therein through which bolts 47 pass and which permit lateral adjustment of plate 48 along support 27 when bolts 47 are loosened. Attached to plate 48 by welding or other means is a rod 51 to which another rod 52 is adjustably threaded and with a lock nut 53 threaded onto rod 52 for locking the adjusted position of the two rods.

The lower end of rod 52 is slotted as at 54 to form a yoke with a pair of arms 55. A cross member 56 is received within slot 54. A bolt 57 passes through openings in arms 55 and cross member 56 and when tightened deflects arms 55 into tight contact with cross member 56 to fix the angular position of the same relative to rod 52. A plate 58 is welded or otherwise fixedly attached to cross member 56 and has a slot 60 therein for receiving an externally threaded fitting 61. A pair of lock nuts 62 clamps fitting 61 in a fixed position on plate 60. Fitting 61 is attached at its lower end to hose 64. A bore 65 through the fitting communicates with the interior of hose 64, a replaceable nozzle tip 66 is attached to fitting 61 by a threaded nut 67 and has a discharge opening 68.

Figure 4:
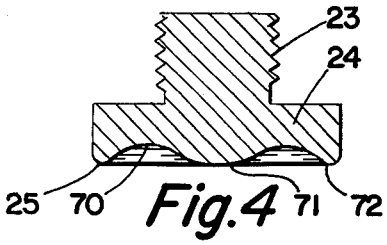
FIG. 4 is an enlarged view of a portion of the acoustical horn with one form of impingement surface.
Figure 5:
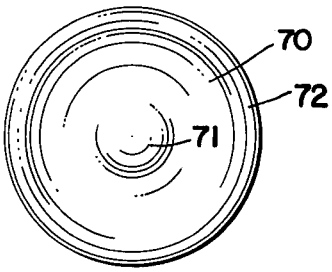
FIG. 5 is an end view of FIG. 4.

In one application of the device shown in FIG. 1, plate 48 is so positioned on support 27 and cross member 56 angularly positioned on rod 52 so that fitting 61 will be axially aligned with the longitudinal axis of horn 10. Also, the threaded connection between rods 51 and 52 will be adjusted so that the upper end of fitting 61 will be spaced a predetermined axial distance from impingement surface 25 of member 24. In this case, impingement surface 25 is preferrably formed in the manner shown more clearly in FIGS. 4 and 5 wherein impingement surface 25 includes an annular recess 70 between a central convexly curved portion 71 and an outer annular rim 72. With this configuration, liquid flowing from fitting opening 68 impinges upon the radially inner portion of annular recess 70 to be broken up into small liquid particles and be deflected downwardly and radially outwardly so as to spray around fitting 61. Energization of electrical contactor 16 causes the piezoelectric crystals 14, 15 to impart ultrasonic vibration to horn 10, which includes impingement surface 25. The high acceleration of these vibrations causes the liquid, and solids that may be in the liquid, impinging thereagainst to be broken up into smaller particles than would be the case if surface 25 was not subjected to ultrasonic vibration.

Figure 3:
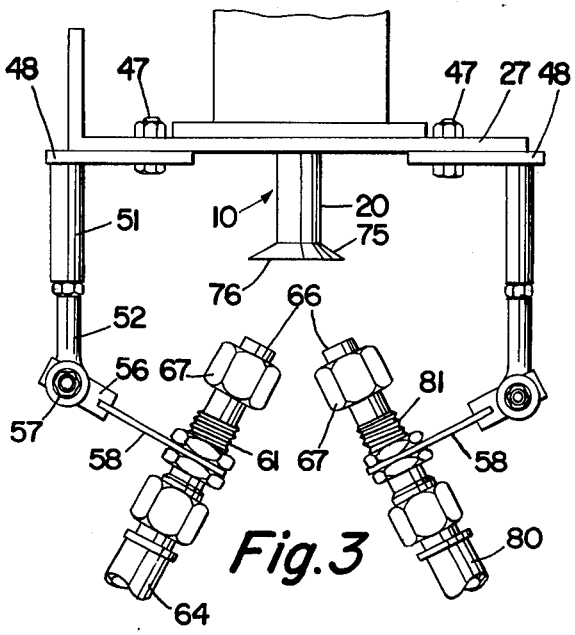
FIG. 3 is a view showing two external conduits directed toward a single ultrasonic device.

As illustrated in FIG. 3, the angular orientation of fitting 61 with respect to the impingement surface of the acoustical horn may be varied. This is accomplished by loosening bolts 47 and sliding plate 48 along support 27 to a new position, after which bolts 47 are tightened, and loosening bolt 57 and rotating cross member 56 to a different angular position relative to rod 52, after which bolt 57 is again tightened. In this case, it may be more desirable to have a different adaptor 75 attached to reduced portion 20 of horn 10 and which provides a flat impingement surface 76. Furthermore, the spacing of fitting 61 from surface 76 can be further adjusted by the threaded connection between rods 52 and 51.

Also as indicated in FIG. 3, a second conduit 80 with a corresponding fitting 81 can be utilized by mounting another plate 48 to support 27 and which additional plate carries another set of rods 51, 52, cross member 56 and plate 58. The spacing and angular location of the second fitting 81 with respect to horn impingement surface 76 can be adjusted in the same manner as for fitting 61.

When two conduits 64, 80 are used, as shown in FIG. 3, they may direct either like or dissimilar liquids against impingement surface 76. Thus, this arrangement may be used when it is desired to either mix two dissimilar liquids or where it is desired to emulsify two different liquids.

Figure 6:
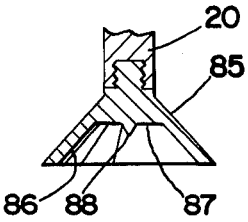

FIG. 6 shows a modified form of adaptor 85 that may be used for providing the impingement surface for the acoustical horn. In this case, adaptor 85 has a conical recess 86 with a bottom wall 87 that is shown flat but which may be curved somewhat, and there is a raised central portion 88 on the bottom wall. When using this adaptor 85, a single conduit 64 would be used and the fitting 61 would be in axial alignment with the acoustical horn. Fluid impinging on the bottom wall 87 would tend to be deflected therefrom in a spray cone having an included angle about the same as the included angle of conical surface 86.

Figure 7:
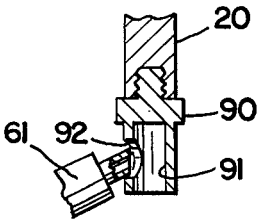

FIG. 7 shows another form of adaptor 90 having a cylindrical recess 91. In this case, the end of fitting 61 is within a side opening 92 leading to recess 91 and intermediate the ends thereof. In this case, the liquid droplets leave the adaptor in a spray pattern that is substantially cylindrical.

Figure 8:
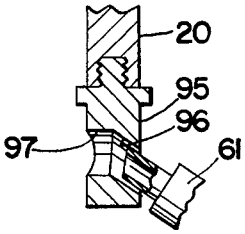
FIGS. 6, 7 and 8 are cross section views showing modified forms of the impingement surfaces of the acoustical horn.

FIG. 8 illustrates still another form of adaptor 95 in which there is a passage substantially transversely therethrough. The passage has a first portion 96 that is at an angle to the longitudinal axis of the acoustical horn and another portion 97 that is substantially normal to such longitudinal axis. In this case, the liquid droplets leave passage 97 in a lateral direction.

With the forms of adaptors shown in FIGS. 7 and 8 the end of nozzle tip 66 fits loosely within the respective passages 92, 96 so as to be out of contact with the walls thereof whereby the ultrasonic vibrations imparted to adaptors 90, 95 are not transmitted to the nozzle tip.

We claim:

1. An atomizing device comprising a support, an acoustical horn mounted on the support, an ultrasonic generator engaging the horn to impart ultrasonic vibrations thereto when the generator is energized, said horn including a radially extending face integral therewith and opposed to a face on the support, a resilient member between said faces to separate and vibrationally isolate the horn relative to the support, means for attaching said horn to said support with said resilient means clamped between said faces, and said horn having a surface against which liquid may be impinged for atomizing the same.

2. The device of claim 1 in which there is a housing separate of the support and surrounding said generator and at least a portion of the horn, and means for attaching the housing to said support, said housing attachment means including means for varying the rotative position of the housing relative to the support.

3. An atomizing device comprising a support, an acoustical horn mounted on the support, an ultrasonic generator engaging the horn whereby when the generator is energized it imparts vibrations to the horn in the ultrasonic frequency range, said horn having a reduced diameter portion spaced from the generator, an opening in the support, said reduced diameter portion of the horn extending completely through said opening, means attaching the horn to said support including a flange on the horn extending radially beyond said opening with one side of the flange being opposite a face on the support, an annular member overlying another face of the flange and bolted to said support, and resilient means on each side of the flange and clamped between the flange and a respective one of said faces to vibrationally isolate the horn relative to the support, and said reduced diameter portion having a surface against which a liquid may be impinged.

4. The device of claim 3 in which said flange is closely adjacent the reduced diameter portion.

5. The device of claim 3 in which said support includes a bracket with means for attachment to another supporting structure, and said support includes an annular ring that provides said support face, and means for rigidly clamping said annular ring to said bracket.

6. An atomizing device comprising an acoustical horn, an ultrasonic generator engaging the horn to impart ultrasonic vibrations to the horn when the generator is energized, said horn having a portion with a surface facing axially away from said generator against which a liquid flowing generally toward said generator may be impinged, and said portion being detachably connected to said horn whereby said portion may be replaced by another horn portion while maintaining the engagement between the horn and generator.

7. An atomizing device comprising an acoustical horn, an ultrasonic generator engaging the horn to impart ultrasonic vibrations thereto when the generator is energized, said horn having a portion with a surface against which liquid may be impinged, a conduit for conveying liquid, said conduit having an open end, and means for supporting the conduit with said open end in axial alignment with said horn portion and in spaced relation to said surface for directing liquid flowing from said conduit through said open end against said surface and said means also supporting said horn in vibrational isolation thereto.

8. The device of claim 7 in which said surface is shaped to deflect liquid flowing thereagainst in an axial direction to a non-axial direction.

9. The device of claim 7 in which there is a means for adjusting the axial spacing between said open end and said surface.

10. The device of claim 7 in which said surface is shaped to deflect said liquid in a conical pattern.

11. The device of claim 7 in which said surface has an annular groove therein against which said liquid may impinge.

12. An atomizing device comprising a support, an acoustical horn mounted on the support, an ultrasonic generator engaging the horn to impart ultrasonic vibrations thereto when the generator is energized, an arm projecting from the support, a conduit for liquid attached to said arm, said arm comprising a first portion attached to said support and a second portion attached to said conduit, said portions being connected to each other by a means that permits angular adjustment of the portions relative to each other, said conduit having an open end, and said horn having a surface spaced from said open end and in the flow path of liquid flowing from the conduits to said open end.

13. An atomizer device comprising an acoustical horn having an impingement surface thereon, an ultrasonic generator engaging the horn to impart ultrasonic vibrations thereto when the generator is energized, and means for simultaneously directing two streams of liquid against said surface.

14. The device of claim 13 in which there are means for adjusting the position of each conduit relative to said surface.

15. An atomizing device comprising an acoustical horn, an ultrasonic generator engaging the horn to impart ultrasonic vibrations thereto when the generator is energized, said horn having a portion against which liquid may be impinged, said portion having a recess with a bottom wall and a side wall flaring outwardly from the bottom wall toward the open end of the recess.

16. The device of claim 15 in which the bottom wall has a raised center portion.

17. An atomizing device comprising an acoustical horn, an ultrasonic generator engaging the horn to impart ultrasonic vibrations thereto when the generator is energized, said horn having a portion against which liquid may be impinged, said portion including a recess with a side wall, and an opening through the side wall through which liquid may be directed into the recess.

18. An atomizing device comprising an acoustical horn, an ultrasonic generator engaging the horn to impart ultrasonic vibrations thereto when the generator is energized, said horn having a portion against which liquid may be impinged, said portion having a passage extending generally transversely therethrough, said passage including a first portion into which liquid may be introduced and a second portion from which the liquid may be discharged, and said passage portions being angularly disposed relative to each other whereby liquid entering the first passage portion will impinge against a portion of the wall of the second passage portion.

* * * * *